United States Patent [19]

Horikawa et al.

[11] Patent Number: 4,743,427

[45] Date of Patent: May 10, 1988

[54] HIGH POTENT AND HIGH ELECTROCONDUCTIVE COPPER ALLOY SUITABLE FOR FIN MATERIAL OF HEAT-EXCHANGER

[75] Inventors: Hiroshi Horikawa, Nikko; Norimasa Satou, Utsunomiya; Akihiro Ooguri, Imaichi; Kenichi Omata, Nikko, all of Japan

[73] Assignee: The Furukawa Electric Co., Ltd., Tokyo, Japan

[21] Appl. No.: 911,361

[22] Filed: Sep. 25, 1986

[30] Foreign Application Priority Data

Sep. 26, 1985 [JP] Japan ..... 60-213287

[51] Int. Cl.[4] ..... C22C 9/04

[52] U.S. Cl. ..... 420/477; 420/494; 148/413; 148/434

[58] Field of Search ..... 420/477, 494; 148/413, 148/434

[56] References Cited

FOREIGN PATENT DOCUMENTS 119633 6/1986 Japan ..... 420/477
119634 6/1986 Japan ..... 420/477

OTHER PUBLICATIONS

Ueyama, Sato, and Saito, "High Strength and Conductivity of the Copper-FMZ Alloy," *Chemical Abstracts,* vol. 90, 125758t, 1979.

*Primary Examiner*—L. Dewayne Rutledge
*Assistant Examiner*—George Wyszomierski
*Attorney, Agent, or Firm*—Oblon, Fisher, Spivak, McClelland & Maier

[57] ABSTRACT

A high electroconductive copper alloy is disclosed which contains 0.003 to 1.0 wt % of Zn, 0.005 to 0.1 wt % of Mg and the remainder of Cu. Not more than 0.1 wt % of the total amount of either one or more of Cr, Mn, Fe, Co, Ni, Y, Sn, Si and Zr may be contained further, while the amount of oxygen contained is confined to not more than 100 ppm in both cases.

5 Claims, No Drawings

HIGH POTENT AND HIGH ELECTROCONDUCTIVE COPPER ALLOY SUITABLE FOR FIN MATERIAL OF HEAT-EXCHANGER

BACKGROUND OF THE INVENTION

The present invention relates to a copper alloy for high potency and high electric conductance which is suitable for the fin material of heat-exchanger, in particular, heat-exchanger for motor cars and excellent in the thermal conductivity, heat resistance, corrosion resistance and strength.

In general, excellent electroconductivity, thermal conductivity and heat resistance are requested for the fin material of heat-exchanger, and copper alloy added 0.1 to 1.0 wt % (hereinafter wt % is abbreviated simply as %) of Sn to Cu has been used conventionally. Particularly, for the fin of a radiator (heat-exchanger) for motor cars, a thin plate consisting of the foregoing alloy and having a thickness of 0.03 to 0.1 mm is used.

Recently, from the viewpoint of energy conservation, high performance of various instruments has become necessary together with miniaturization thinning and weight reduction, and, for the fin material of heat-exchanger, too, high performance as well as thinning and lightening have become necessary. Moreover, detrimental substances such as chlorine, nitrogen oxides, sulfur dioxide gas, etc. have been increased in the air recently causing corrosion problems. In particular, for the fin of radiator for motor cars, the deterioration of the environment is serious because of the scattering of chlorine compounds on the road as the antifreezing agents and so on in addition to the increase in the detrimental substances aforementioned. As a result, the corrosion of the fin has also been increased and the lowering in the radiation property has become a subject of discussion. Therefore, such copper alloy as has excellent corrosion resistance and strength together with excellent electroconductivity and heat resistance is desired.

As a result of extensive studies a high potent and high electroconductive copper alloy is now provided by the present invention, which has a heat resistance equal to that of a conventional alloy and superior mechanical properties, electroconductivity and corrosion resistance.

SUMMARY OF THE INVENTION

One of the alloys of the invention is characterized in that it contains 0.003 to 1.0% of Zn and 0.005 to 0.1% of Mg and the remainder consists of Cu. It is characterized further in that it contains 0.003 to 1.0% of Zn and 0.005 to 0.1% of Mg, the amount of oxygen contained is not more than 100 ppm, preferably not more than 60 ppm, and the remainder consists of Cu.

Moreover, in another aspect of the invention an alloy is provided which is characterized in that it contains 0.003 to 1.0% of Zn and 0.005 to 0.1% of Mg, it contains further not more than 0.1% of the total amount of either one or more of Cr, Mn, Fe, Co, Ni, Y, Sn, Si and Zr, and the remainder consists of Cu. It is characterized further in that it contains 0.003 to 1.0% of Zn and 0.005 to 0.1% of Mg, it contains further not more than 0.1% of the total amount of either one or more of Cr, Mn, Fe, Co, Ni, Y, Sn, Si and Zr, the amount of oxygen contained is not more than 100 ppm, preferably not more than 60 ppm, and the remainder consists of Cu.

DETAILED DESCRIPTION OF THE INVENTION

In the invention, the addition of Zn is made for the inhibition of the formation and the proliferation of $Cu_2O$ in the air mixed with chlorine, nitrogen oxides, sulfur dioxide gas, etc. without lowering so much the electroconductivity (thermal conductivity) proper to Cu to improve the corrosion resistance. The reason why the content of Zn was confined to 0.003 to 1.0% is due to the facts that, if the content is under 0.003%, the action to improve the corrosion resistance is small and, if over 1.0%, the lowering in the electroconductivity (thermal conductivity) becomes remarkable though the corrosion resistance is improved. Moreover, Mg is added aiming at that the mechanical properties and the softening temperature are raised and the corrosion resistance is further improved due to the synergistic effect with Zn without lowering the electroconductivity (thermal conductivity). The reason why the content of Mg was confined to 0.005 to 0.1% is due to that, if the content is under 0.005%, the softening temperature is low and the improvement in the corrosion resistance is insufficient and, if over 0.1%, the lowering in the electroconductivity (thermal conductivity) becomes remarkable.

Furthermore, the addition of either one or more of Cr, Mn, Fe, Co, Ni, Y, Sn, Si and Zr is made for the purpose of further improvement in the strength, and the reason why the total content thereof was confined to not more than 0.1% is due to that, if the total content is over 0.1%, the lowering in the electroconductivity (thermal conductivity) becomes remarkable. Further, the reason why the amount of oxygen contained was confined to not more than 100 ppm, preferably not more than 60 ppm is because of obtaining stable characteristics of alloy and because of that, if the amount of oxygen contained exceeds 100 ppm, the lowering and the dispersion in the characteristics occur through the oxidation of active elements added such as Mg, Zn, etc. Namely, by confining the content of oxygen, sufficiently stable effects can be obtained and the lowering in the electroconductivity is kept to a minimum with a very small amount of elements to be added for the improvement in the corrosion resistance, strength and heat resistance.

EXAMPLES

Employing a graphite crucible, the tough pitch copper was melted in vacuum and to this was added various elements shown in Table 1. These were casted into a metal mold to make ingots with a thickness of 25 mm, a width of 250 mm and a length of 250 mm. After planed each face by 2.5 mm per face, these ingots were heated, submitted to hot rolling at 850° C., and then cold rolling and intermediate annealing were repeated to finish to plates with a thickness of 0.5 mm.

Of the alloy plates thus obtained, the tensile strength, softening temperature, electroconductivity and amount reduced by the corrosion were measured. These results are shown in Table 2.

Besides, the softening temperature was shown by a temperature at which the tensile strength after the heat treatment for 5 minutes in a salt bath became a half of the strength before the heat treatment. Moreover, the corrosion resistance was determined by treating a sample 100 by 100 mm cut off from the plate aforementioned in a way that, after allowed to stand for 48 hours in the air containing 0.3% of $SO_2$ gas and 0.3% of $Cl_2$ gas, it was kept for 48 hours in a thermohygrostat with a temperature of 60° C. and a humidity of 80%, and this procedure was repeated four times, by removing the corrosion product $Cu_2O$ on the surface of sample to measure the weight and by calculating the amount reduced by the corrosion from the difference in weights before and after the test.

TABLE 1

| Alloy | No. | Composition of alloy (%) | | | | | | | | | | | | |
|---|---|---|---|---|---|---|---|---|---|---|---|---|---|---|
| | | Zn | Mg | Cr | Mn | Fe | Co | Ni | Y | Sn | Si | Zr | $O_2$ | Cu |
| Alloy of the invention | 1 | 0.01 | 0.030 | — | — | — | — | — | — | — | — | — | 0.0011 | Balance |
| Alloy of the invention | 2 | 0.52 | 0.021 | — | — | — | — | — | — | — | — | — | 0.0021 | " |
| Alloy of the invention | 3 | 0.98 | 0.077 | — | — | — | — | — | — | — | — | — | 0.0019 | " |
| Alloy of the invention | 4 | 0.08 | 0.021 | 0.009 | — | — | — | — | — | — | — | — | 0.0051 | " |
| Alloy of the invention | 5 | 0.04 | 0.008 | — | 0.081 | — | — | — | — | — | — | — | 0.0032 | " |
| Alloy of the invention | 6 | 1.00 | 0.010 | — | — | 0.052 | — | — | — | — | — | — | 0.0091 | " |
| Alloy of the invention | 7 | 0.93 | 0.044 | 0.012 | — | — | — | — | — | — | — | — | 0.0013 | " |
| Alloy of the invention | 8 | 0.98 | 0.093 | — | — | — | 0.004 | — | — | — | — | — | 0.0033 | " |
| Alloy of the invention | 9 | 0.96 | 0.065 | — | — | — | — | 0.012 | — | — | — | — | 0.0009 | " |
| Alloy of the invention | 10 | 0.59 | 0.019 | — | — | — | — | — | 0.088 | — | — | — | 0.0028 | " |
| Alloy of the invention | 11 | 0.62 | 0.007 | 0.050 | — | — | — | — | — | 0.023 | — | — | 0.0046 | " |
| Alloy of the invention | 12 | 0.93 | 0.036 | — | — | — | 0.008 | — | — | — | 0.004 | — | 0.0031 | " |
| Alloy of the invention | 13 | 0.96 | 0.041 | — | 0.006 | — | — | — | — | — | — | 0.032 | 0.0081 | " |
| Alloy of the invention | 14 | 0.18 | 0.022 | — | — | 0.041 | — | — | 0.008 | — | — | — | 0.0077 | " |
| Alloy of the invention | 15 | 0.23 | 0.009 | — | — | — | — | 0.021 | — | 0.033 | — | 0.009 | 0.0063 | " |
| Comparative alloy | 16 | 0.002 | 0.063 | — | — | — | — | — | — | — | — | — | 0.0090 | " |
| Comparative alloy | 17 | 3.98 | 0.041 | — | — | — | — | — | — | — | — | — | 0.0044 | " |
| Comparative alloy | 18 | 0.21 | 0.001 | — | — | — | — | — | — | — | — | — | 0.0111 | " |
| Comparative alloy | 19 | 2.71 | 0.240 | — | — | — | — | — | — | — | — | — | 0.0021 | " |
| Comparative alloy | 20 | 0.57 | 0.030 | — | — | — | — | — | — | — | — | — | 0.0130 | " |
| Comparative alloy | 21 | 1.88 | 0.033 | — | — | — | — | — | — | 0.045 | 0.079 | — | 0.0019 | " |
| Comparative alloy | 22 | 2.49 | 0.084 | 0.056 | — | — | 0.021 | — | — | — | — | 0.043 | 0.0099 | " |
| Comparative alloy | 23 | 2.29 | 0.002 | — | — | 0.002 | — | — | — | — | — | — | 0.0062 | " |
| Comparative alloy | 24 | 0.001 | 0.311 | — | — | — | — | 0.046 | — | — | — | — | 0.0073 | " |
| Comparative alloy | 25 | 2.11 | 0.011 | — | — | — | — | — | 0.006 | — | — | — | 0.0013 | " |
| Conventional alloy | 26 | — | — | — | — | — | — | — | — | 0.16 | — | — | 0.0054 | " |

TABLE 2

| Alloy | No. | Tensile strength (kg/mm²) | Softening temperature (°C.) | Electroconductivity (% IACS) | Amount reduced by corrosion (mg/cm²) |
|---|---|---|---|---|---|
| Alloy of the invention | 1 | 39.0 | 365 | 95 | 2.69 |
| Alloy of the invention | 2 | 38.5 | 365 | 94 | 2.00 |
| Alloy of the invention | 3 | 40.5 | 380 | 91 | 1.91 |
| Alloy of the invention | 4 | 38.0 | 370 | 94 | 2.63 |
| Alloy of the invention | 5 | 38.2 | 375 | 88 | 2.58 |
| Alloy of the invention | 6 | 40.3 | 375 | 87 | 1.94 |
| Alloy of the invention | 7 | 38.4 | 360 | 88 | 2.11 |
| Alloy of the invention | 8 | 40.6 | 390 | 91 | 1.84 |
| Alloy of the invention | 9 | 40.4 | 370 | 88 | 1.73 |
| Alloy of the invention | 10 | 41.1 | 370 | 93 | 1.93 |
| Alloy of the invention | 11 | 40.9 | 375 | 90 | 2.35 |
| Alloy of the | 12 | 38.6 | 385 | 90 | 1.84 |

TABLE 2-continued

| Alloy | No. | Tensile strength (kg/mm$^2$) | Softening temperature (°C.) | Electroconductivity (% IACS) | Amount reduced by corrosion (mg/cm$^2$) |
|---|---|---|---|---|---|
| invention | | | | | |
| Alloy of the invention | 13 | 39.4 | 380 | 88 | 1.70 |
| Alloy of the invention | 14 | 40.9 | 380 | 86 | 2.46 |
| Alloy of the invention | 15 | 39.5 | 365 | 88 | 2.59 |
| Comparative alloy | 16 | 39.4 | 355 | 96 | 2.85 |
| Comparative alloy | 17 | 41.6 | 375 | 77 | 0.98 |
| Comparative alloy | 18 | 35.8 | 330 | 95 | 2.66 |
| Comparative alloy | 19 | 43.9 | 380 | 76 | 1.12 |
| Comparative alloy | 20 | 39.6 | 345 | 92 | 2.46 |
| Comparative alloy | 21 | 43.5 | 395 | 74 | 1.85 |
| Comparative alloy | 22 | 39.4 | 395 | 71 | 1.18 |
| Comparative alloy | 23 | 36.5 | 340 | 93 | 1.09 |
| Comparative alloy | 24 | 43.0 | 385 | 74 | 3.05 |
| Comparative alloy | 25 | 35.9 | 330 | 95 | 1.39 |
| Conventional alloy | 26 | 37.5 | 370 | 85 | 2.74 |

As evident from Table 1 and Table 2, it can be seen that the alloys of the invention No. 1 through 15 have all at least equivalent heat resistance and more excellent tensile strength, electroconductivity and corrosion resistance compared with those of the conventional alloy No. 26. In addition, the characteristics of the alloy according to the invention are improved by the incorporation of either one or more of Cr, Mn, Fe, Co, Ni, Y, Sn, Si and Zr, and further, they are improved more by the restriction of the amount of oxygen contained to not more than 100 ppm, preferably not more than 60 ppm.

Whereas, in the cases of the comparative alloys No. 16 through 25, the composition of alloy being out of that prescribed by the invention, it is seen that at least one of tensile strength, heat resistance, electroconductivity and corrosion resistance are inferior. Namely, in the cases of No. 16 and No. 24 wherein the content of Zn is less, the corrosion resistance is low and, in the cases of the comparative alloys No. 18, No. 23 and No. 25 wherein the content of Mg is less, the tensile strength and the heat resistance are low. Moreover, in the cases of the comparative alloy No. 17 wherein the content of Zn is too much, No. 19 wherein the content of Mg is too much and No. 21 and No. 22 wherein the content of either one or more of Cr, Mn, Fe, Co, Ni, Y, Sn, Si and Zn is too much, it is recognized that the electroconductivity is inferior. Furthermore, in the cases of the comparative alloys No. 18 and No. 20 wherein the amount of oxygen is too much, the heat resistance and the corrosion resistance are seen to be inferior.

As described, the alloy of the invention is excellent in the thermal conductivity (electroconductivity), heat resistance, mechanical strength and corrosion resistance, and makes the thinning and lightening in weight and the high performance possible as the fin of heat-exchanger, in particular, heat-exchanger for motor cars resulting in an increase in the life time thereof and the like at the same time. Therefore, the invention exerts remarkable effects industrially.

What is claimed is:

1. A highly electroconductive copper alloy having improved tensile strength and corrosion resistance consisting essentially of 0.003 to 1.0 wt.% of Zn, and 0.005 to 0.1 wt.% of Mg with the remainder being Cu, and wherein said alloy contains an amount of oxygen of not more than about 100 ppm.

2. The electroconductive copper alloy of claim 1, which further contains not more than 0.1% in total of one or more of Cr, Mn, Fe, Co, Ni, Y, Sn, Si and Zr.

3. The electroconductive copper alloy of claim 2, which contains not more than 0.1% in total of one or more of Cr, Mn, Fe, Co, Ni, Y and Zr.

4. The electroconductive copper alloy of claim 1, wherein said alloy contains not more than 60 ppm of oxygen.

5. A heat exchanger having a radiator fin consisting essentially of the electroconductive copper alloy of claim 1.

* * * * *